United States Patent [19]

Harrison et al.

[11] 4,320,981

[45] Mar. 23, 1982

[54] MATRIX PRINTHEAD APPARATUS

[75] Inventors: Michael Harrison; Wilbern F. Davis, both of Austin, Tex.

[73] Assignee: Data General Corporation, Westboro, Mass.

[21] Appl. No.: 128,702

[22] Filed: Mar. 10, 1980

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,842,955 | 10/1974 | Iwasaki | 400/124 |
| 3,893,220 | 7/1975 | Bittner | 400/124 X |
| 4,004,673 | 1/1977 | Burzlaff et al. | 400/124 |
| 4,117,435 | 9/1978 | Hishida et al. | 400/124 X |
| 4,208,138 | 6/1980 | Volke et al. | 400/124 |

*Primary Examiner*—Paul T. Sewell

*Attorney, Agent, or Firm*—Robert Dulaney; Joel Wall

[57] ABSTRACT

An improved wire matrix ballistic impact printhead apparatus including a plurality of engaging structures for maintaining the armatures of a like plurality of electromagnetic actuators in proper positional alignment with the associated print style, for allowing individual adjustment of armatures to optimize printhead operation, for preloading the armatures with a force that will return them to their original position after the printing operation, and for damping vibrations at printhead operating frequencies.

3 Claims, 4 Drawing Figures

MATRIX PRINTHEAD APPARATUS

BACKGROUND OF THE INVENTION

1. Field of the Invention

The present invention relates generally to printing apparatus, and more particularly, to a high speed matrix-type ballistic impact spring head.

2. Description of the Prior Art

High speed printers have been developed to accomodate the high output speed of information which can be delivered by high speed information handling systems.

Printers employing wire matrix ballistic impact print heads provide multiple hard copies of information at a relatively high speed. These printers are characterized in that for each print cycle, the printer does not print an entire character per impact but instead uses an array of wire styli to print selected combinations of dots serially onto the recording medium so that as the recording medium is moved relative to the printhead, successive print cycles generate alpha-numeric characters or other informational indicia. Printheads of this type typically use a separate electromagnetic actuator for each stylus within the printhead.

Ballistic-type matrix print heads generally comprise a stylus guide assembly, a plurality of electromagnetic structures coupled to the guide assembly, each structure including an inner pole piece, an outer pole piece and a coil wrapped around the inner pole piece. A plurality of armatures are disposed radially about the guide assembly. Each armature is associated with one of the electromagnetic structures to form an electromagnetic actuator for transferring electromechanical energy to a stylus. Each of the armatures has an inner end and an outer end projecting outwardly of the associated outer pole piece. A plurality of styli are respectively associated with the plurality of armatures, each stylus being carried by the guide assembly and having an armature engaging end for engaging the inner end of the associated armature and a printing end for impacting a record medium when the stylus is propelled through the guide assembly by energization of the associated electromagnetic actuator.

Ballistics type matrix print heads usually include one or more armature retainers coupled to the guide assembly for retaining each armature in engagement with its associated outer pole. One known ballistics-type matrix printer, as disclosed in U.S. Pat. No. 3,929,214, incorporated herein by reference, uses an armature retainer comprised of a single unitary connector having a central portion connected to the guide assembly and a plurality of resilient arms extending axially outward from the central portion. Each of the arms engages the outer end of one of the plurality of armatures for biasing the armature into engagement with the associated outer pole, while at the same time applying a moment of force to the armature tending to cause the inner end thereof to rotate about the outer pole toward the central portion of the connector.

It is necessary to maintain engagement between the armature and its associated outer pole piece in order to maintain an appropriate magnetic path for the associated electromagnetic actuator. Further, it is desirable to bias the inner ends of the armatures upwardly toward the center portion of the connector for contact with a shock absorbing member mounted therein. Such biasing is intended to effect a simultaneous mutual alignment of the armatures' inner ends so that all actuated styli will strike a record medium at substantially the same instant of time.

However, the unitary connector type of armature retainer described above has led to some disadvantages and problems. For one, the biasing force tending to hold each armature engaged with its associated outer pole piece and to rotate the armature inner end upwardly relative to such outer pole piece is applied on an individual basis by the associated resilient arm of the unitary connector. Thus, since there is the possibility of distortion in some arms and general non-uniformity of structure and design among the arms as a whole due to the fabrication process, it will be apparent that there may be corresponding non-uniformity of armature travel. Such non-uniformity may, of course, result in some of the actuated styli striking the record medium at different instants of time. No capability exists to adjust or modify individual armature travel with this prior art unitary type connector.

Another problem with the unitary connector type of armature retainer results from the resilient nature and use of plural individual arms. It has been found that these arms tend to break off by persons either assembling the head, mounting it into a matrix printer unit, or operating such printer. More specifically, since the arms are independently movable relative to one another, they can be inadvertently bent and broken off. This is especially true when considering the fact that the armature outer ends extend outwardly of the head as a whole. They can thus get caught and moved upwardly, thereby causing the associated arm to be bent upwardly and thereby either distorted or broken.

Another known ballistics-type printhead, as disclosed in U.S. Pat. No. 4,051,941, incorporated herein by reference, uses an armature retainer which is a relatively rigid disc. The armature biasing forces are applied to the armature's outer ends by a rubber O-ring mounted to a peripheral portion of the disc. This retainer also has the problem of possible distortion or general non-uniformity of structure which could result in non-uniformity of armature travel and, as with the previously discussed retainer, it provides no capability to modify individual armature travel distance to correct for distortion or variations in the retainer or in other printhead piece parts.

These and other problems of the prior art are solved by the present invention. The present invention relates to a novel ballistics matrix printhead design having an improved technique of armature retention which is free of the above-mentioned disadvantages and problems.

BRIEF SUMMARY OF THE INVENTION

The present invention relates to improved matrix print head apparatus employing electromagnetic structures and armatures associated therewith. The present invention includes engaging structures for engaging the armatures and constraining undesired movement thereof. In a particular construction of the present invention, each electromagnetic structure has a clip and a spring mounted thereon.

It is a further feature of the present improvement that the mated clip and spring perform the combined functions of biasing the armature, stabilizing the armature with reference to the actuator and damping the motion of the armature during the return portion of the print cycle.

It is another feature of the improvement that the clip and spring are inexpensive and easy to manufacture using established injection molding techniques.

It is a further feature that the use of individual clips and springs for each actuator allows for individual adjustment of actuator/armature spacing, whereby variations in manufactured parts can be accommodated and precise dot registration can be established.

Other features and advantages of the present invention will be understood by those of ordinary skill in the art after referring to the detailed description of preferred embodiments and drawings wherein:

DESCRIPTION OF THE PREFERRED EMBODIMENT

Figure 1:
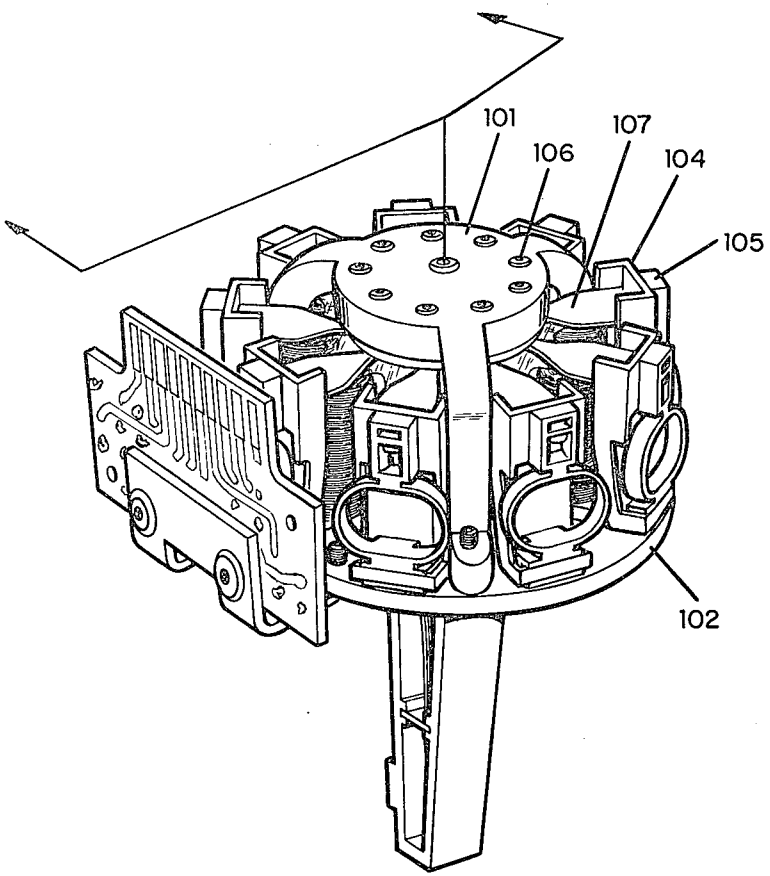
FIG. 1 is a perspective view of a printhead incorporating the present invention.

Referring to FIG. 1, a perspective view of the printhead is presented. The printhead is of the wire matrix ballistic type substantially as described in U.S. Pat. No. 3,929,214, but incorporating the improvements of at least an individual clip 104 and spring 105 for each armature 107. It is advantageous to manufacture clip 104 and spring 105 out of plastic because of the light weight, low cost and inherent internal damping characteristic, which avoids the problems with resonance that metal springs would be subject to at print speed frequencies.

Backplate 101 is fixedly mounted onto base plate 102 and has nine set screws 106 mounted through it whereby the initial position, and therefore the travel distance, of individual armatures can be precisely adjusted to accommodate variations in piece part manufacture, thereby achieving optimum dot registration in the printed character.

Figure 2:
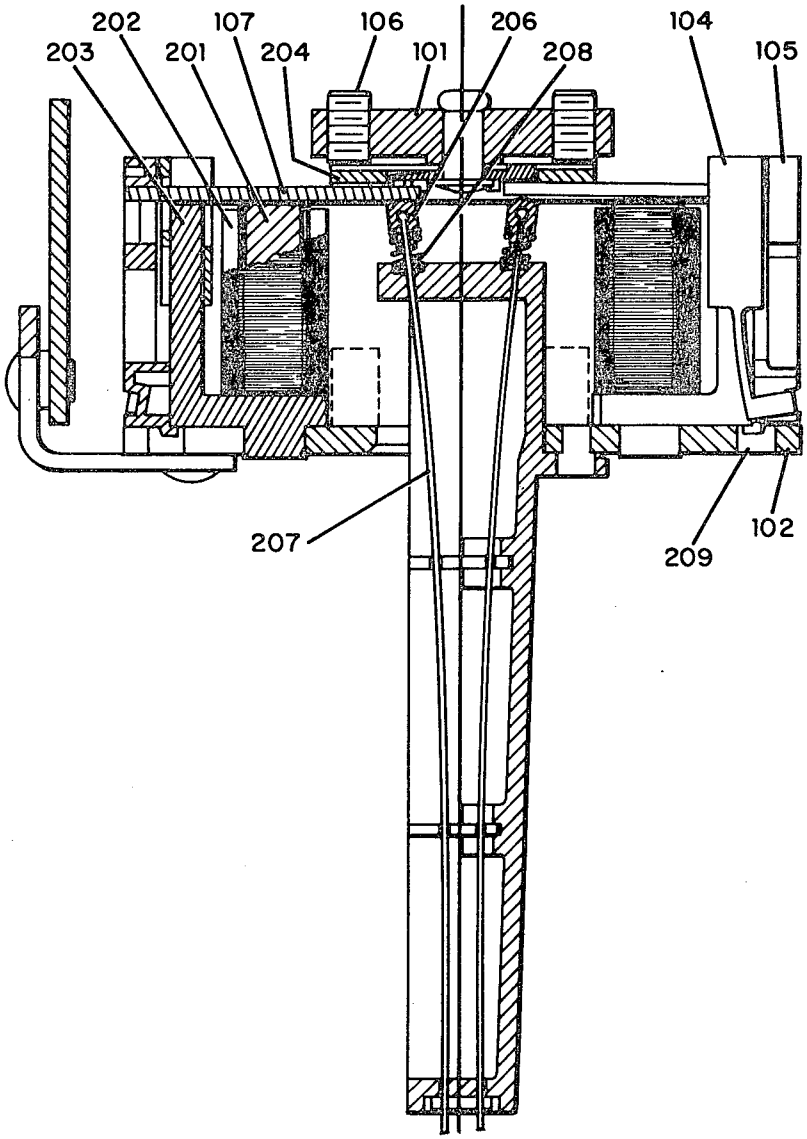
FIG. 2 is a cross-section view of the printhead.

FIG. 2 is a cross section view of the printhead. To enhance the understandability of the present improvement certain elements on the upper right side of FIG. 2 are shown in side view, rather than a true cross section.

Center pole 201, coil 202 and outer pole 203 form the electromagnetic means for causing motion of armature 107. When the actuator is not energized, stylus spring 208 urges stylus head 206 into contact with armature 107. Energizing of the actuator causes the armature to push on stylus head 206 and thereby impart motion to stylus 207. Shock absorbing material 204 absorbs the energy of armature 107 when the armature is returned to its original position by spring 105. Stylus 207 is urged to return to its original position by stylus spring 208. The gap between center pole 201 and armature 107 can be adjusted by varying the position of set screw 106 in backplate 101.

Figure 3A:
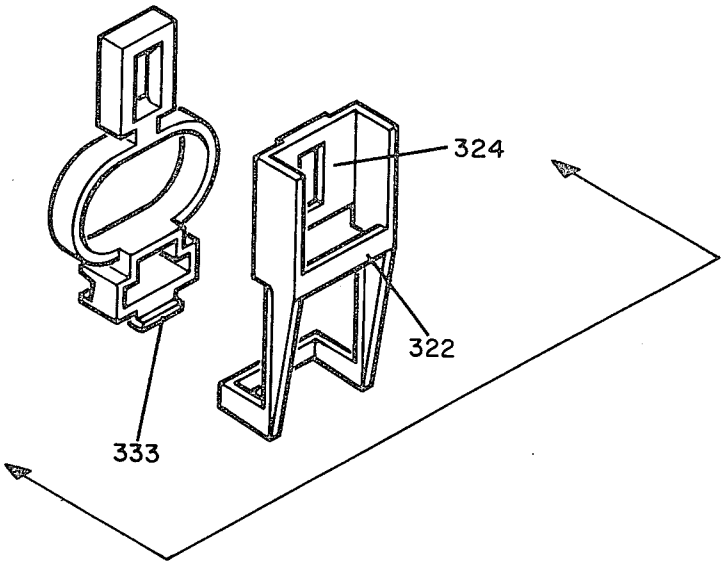
FIG. 3A is a perspective view of the armature clip and the armature spring as seen from a different angle.
Figure 3:
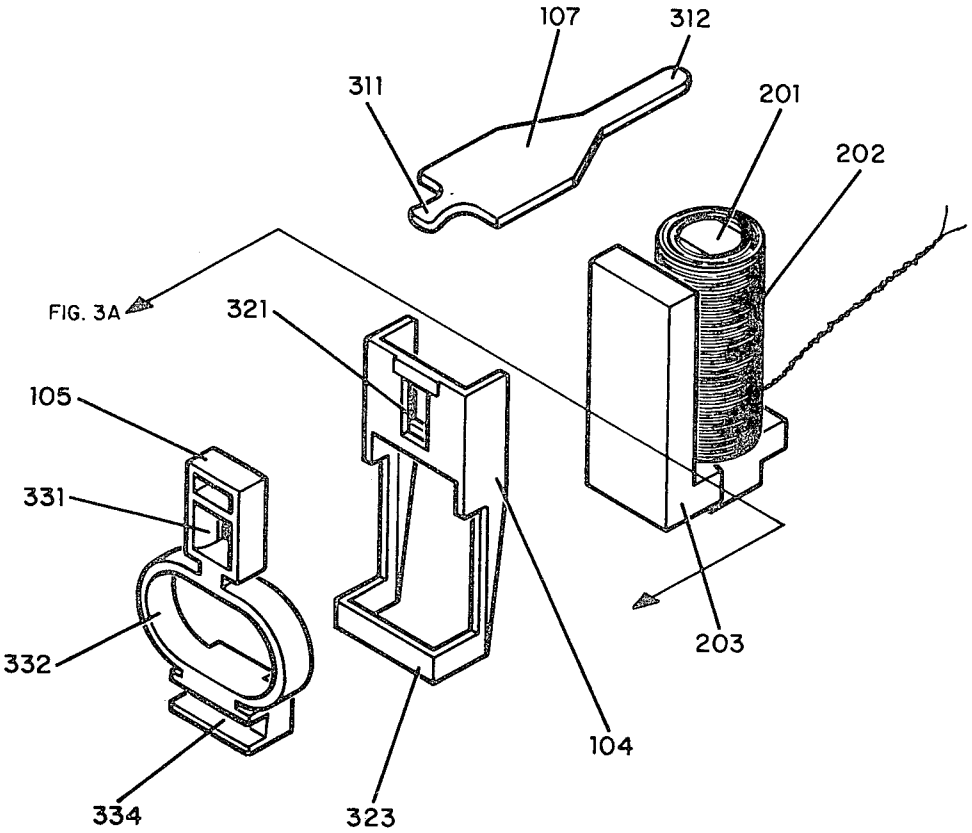
FIG. 3 is an exploded perspective view showing the electromagnetic actuator, the armature, the armature clip and the armature spring.

In FIGS. 3 and 3A, perspective views of the actuator, armature, armature clip and armature spring are presented. Armature clip 104 attaches to armature spring 105 by means of clip segment 323 which engages with spring groove 334 so as to hold apertures 321 and 331 adjacent and in substantial alignment. Armature 107 has a narrow tip 311 on the opposite end from the stylus head impacting end 312. Tip 311 is mounted through apertures 321 and 331 and is slightly flared at its end so as to substantially prevent translational movement of armature 107 toward the center of the printhead, while allowing limited pivotal motion toward and away from stylus head 206.

The combination of clip 104 and spring 105 mounts on to actuator outer pole 203 in a sliding fashion such that the end of outer pole 203 passes between clip element 322 and clip surface 324. Spring lip 333 protrudes into base aperture 209 (FIG. 2) and engages the corner of outer pole 203 so as to prevent inadvertent sliding motion by the clip and/or spring on the outer pole once mounting has been completed.

Operation

Spring 105 is biased so as to provide a force on armature tip 311 in the direction of baseplate 102. This causes armature 107 to pivot about outer pole 203 and urges armature end 312 against shock absorbing material 204. As the print cycle begins, armature 107 is drawn by magnetic flux toward inner pole 201, thereby imparting energy to stylus 207. This motion causes armature tip 311 to move in a direction away from baseplate 102 and, therefore, causes resilient spring 332 to become deformed. After stylus 207 has been propelled by armature 107, coil 202 is deenergized and the magnetic flux is terminated. Resilient spring 332 then begins to return to its original shape and, by exerting force on aperture tip 311 in the direction of baseplate 102, returns the armature to its original position. Further description of other aspects of wire matrix printhead operation is provided in the incorporated-by-reference patents.

The invention may be embodied in yet other specific forms without departing from the spirit or essential characteristics thereof. The present embodiments are therefore to be considered in all respects as illustrative and not restrictive. The scope of the invention is indicated by the appended claims rather than by the foregoing description, and all changes which came within the meaning and range of equivalency of the claims are therefore intended to be embraced therein.

What is claimed is:

1. In a wire matrix printhead having a base; a plurality of axial electromagnetic structures mounted to and disposed around said base, each of said electromagnetic structures having an outer pole, a center pole and a coil disposed around said center pole; a like plurality of armatures and styli, each of said armatures and styli being associated with one of said electromagnetic structures, and each of said armatures having a stylus engaging end and an outer end; said outer end being in contact with one end of said outer pole, and armature retaining apparatus, said armature retaining apparatus comprising:

means for engaging said outer end of said armature such that undesired motion of said armature is substantially precluded;

means for mounting said apparatus on said outer pole, said means having:

spring lip means for latchingly engaging the end of said outer pole opposite from said armature contacting end such that movement of said apparatus along the length of said outer pole is substantially precluded, and clip means for encircling said outer pole such that said apparatus is retained in the proper orientation to said outer pole; and resilient spring means disposed between said armature engaging means and said spring lip means for applying biasing force to said armature.

2. In a wire matrix printhead having a base; a plurality of axial electromagnetic structures mounted to and disposed around said base, each of said electromagnetic structures having an outer pole, a center pole and a coil disposed around said center pole; a like plurality of armatures and styli, each of said armatures and styli being associated with one of said electromagnetic structures, and each of said armatures having a stylus engaging end and an outer end; and armature retaining apparatus, said armature retaining apparatus comprising:

means for mounting said apparatus on said outer pole said mounting means having clip means for encircling said outer pole, and first means for engaging said armature outer end; and bias means having means for engaging said mounting means, spring lip means for latchingly engaging said outer pole to substantially preclude undesired movement of said bias means and said mounting means along the length of said outer pole; and second means for engaging said armature outer end; and resilient spring means disposed between said second armature outer end engaging means and said spring lip means for applying biasing force to said armature, said first and second armature outer end engaging means cooperating to substantially preclude undesired movement of said armature.

3. The armature retaining apparatus of claim 2 and wherein said bias means has a groove formed therein and wherein said mounting means further comprises a protruding segment for mating with said groove such that said first and second armature outer end engaging means are retained in the proper relationship to each other.

* * * * *